United States Patent [19]

Anderson

[11] 4,388,791

[45] Jun. 21, 1983

[54] REBAR TIE

[76] Inventor: Frank H. Anderson, 1580 Grand View Dr., Berkeley, Calif. 74705

[21] Appl. No.: 144,556

[22] Filed: Apr. 28, 1980

[51] Int. Cl.[3] ..... E04C 5/16

[52] U.S. Cl. ..... 52/719; 140/93 B; 140/93 A; 52/686

[58] Field of Search ..... 52/677, 684, 682, 665, 52/685, 686, 712, 719; 140/93 A, 93 B

[56] References Cited

U.S. PATENT DOCUMENTS

| | | | |
|---|---|---|---|
| 919,099 | 4/1909 | Wedmore | 52/685 |
| 959,217 | 5/1910 | Hallahan . | |
| 1,057,431 | 4/1913 | Jackson . | |
| 1,595,122 | 8/1926 | Robinson . | |
| 1,625,838 | 4/1927 | White | 52/682 |
| 1,637,742 | 8/1927 | Edge et al. | 52/685 |
| 1,816,833 | 8/1931 | Ehlers | 52/719 |
| 2,298,104 | 10/1942 | Brunemann . | |
| 2,303,269 | 11/1942 | Goss . | |
| 2,508,093 | 5/1950 | Bithell . | |
| 2,642,966 | 6/1953 | Sylvan . | |
| 3,163,266 | 12/1964 | Nelsson . | |
| 3,356,399 | 12/1967 | Young | 52/712 |
| 3,748,808 | 7/1973 | Sheppard et al. . | |
| 4,114,212 | 9/1978 | Krakauer . | |

FOREIGN PATENT DOCUMENTS

| | | | |
|---|---|---|---|
| 269478 | 1/1914 | Fed. Rep. of Germany | 52/686 |

*Primary Examiner*—James L. Ridgill, Jr.

*Attorney, Agent, or Firm*—Manfred M. Warren; Robert B. Chickering; Glen R. Grunewald

[57] ABSTRACT

A device for securing together crossing re-inforced rods or bars, commonly referred to as rebar, and comprising a spring wire clip having a curved saddle-shaped mid-portion formed to seat on the posterior side of the vertical rebar, i.e., the side away from the horizontal rebar, and having a pair of parallel legs dimensioned to extend across the top of the horizontal rebar and curved in parallel vertical planes to provide concavities to receive, grip and provide vertical support for the horizontal rebar. The clip is formed for manual application in a one-handed operation.

2 Claims, 4 Drawing Figures

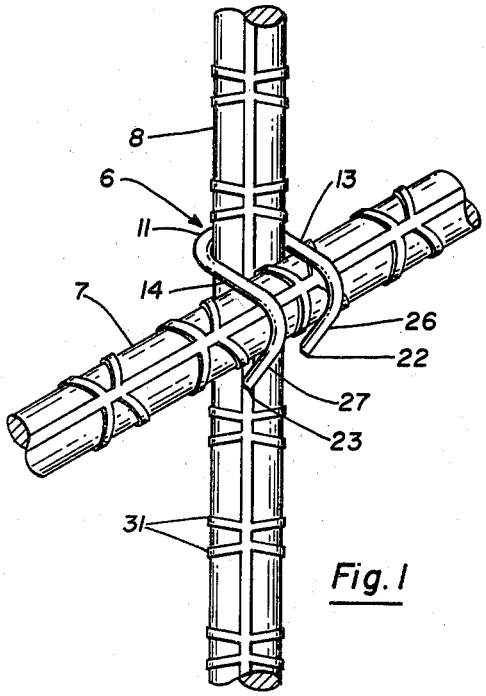
Fig. 1
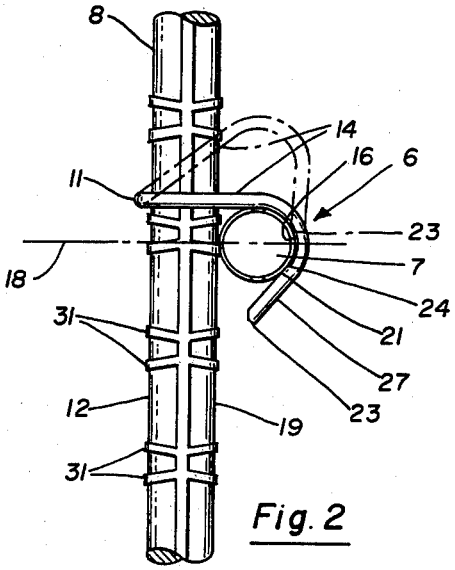
Fig. 2
Fig. 3
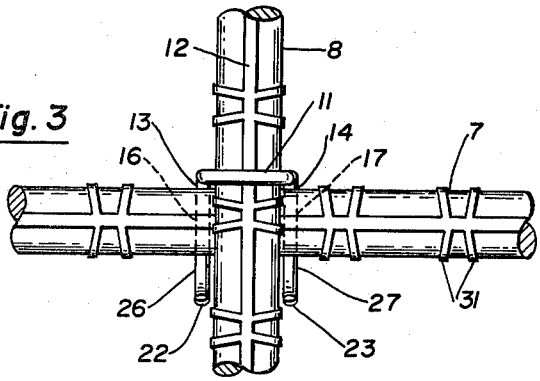
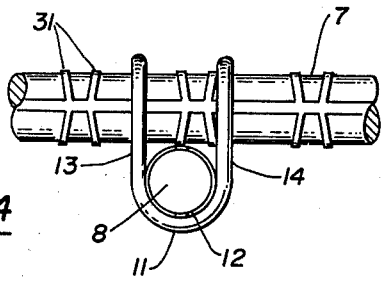
Fig. 4

REBAR TIE

BACKGROUND OF THE INVENTION

The invention relates to the tying means used for securing together the crossing reinforcing rods or bars used in steel reinforced concrete construction. Such conventional reinforcing members are herein referred to by their common designation of rebars.

Heretofore it has been the practice of manually wrapping a tie wire around the intersecting rebars in walls, mats, piers, tie beams, slabs, etc. The tying wire system when applied to vertical walls having vertical and horizontal crossing rebars, requires two workmen, one to hold the horizontal member at desired elevation and the other to wrap the tie wire around the crossing members—a required two handed operation. Where subsequent adjustment of the positioning of the members is required, it can only be accomplished by cutting and removing tie wires and making completely new tie wire connections.

The inventor is familiar with the following prior art U.S. Pat. Nos. which constitute the most pertinent art known to him and which serve to clearly illustrate the novelty of the present invention.

959,217
1,057,431
2,298,104
2,303,269
2,508,093
1,595,122
2,642,966
3,163,266
3,748,808
4,114,212

SUMMARY OF THE INVENTION

There is provided by the present invention a specially designed spring wire clip which is formed and dimensioned for easy and rapid attachment to the crossing reinforcing members, and which will effect the firm attachment of these members together in only a fraction of the time required by conventional wire tying technique. Moreover, the clip is so designed that the smaller and medium sized rebars can be readily supported, positioned and secured by a single workman, who may support a horizontal rebar with one hand and apply the fastening device with the other.

Another and important feature of the present invention is that the device will provide a firm, positive lock of the crossing members with high holding power, thus enabling workmen to climb on the grid as it is formed, supporting their weight on the horizontal rebars. In accordance with the present invention the greater load applied on the horizontal rebar, the greater the holding power of the clip.

A further object of the present invention is to provide a rebar tie of the character described which permits ready and easy adjustment of the crossing location of the rebars. This is effected in accordance with the present invention by merely applying a lifting force to the clip to release it from its interlocking position and which then allows adjustment up, down or sideways of the crossing bars and easy and rapid refastening of the bars in their adjusted position.

Still another object of the present invention is to provide a rebar tie of the character described in which a single size of clip may be used for securing together a number of different sized rebars thus reducing the number of different sized clips required to be inventoried by the contractor.

The invention possesses other objects and features of advantage, some of which of the foregoing will be set forth in the following description of the preferred form of the invention which is illustrated in the drawings accompanying and forming part of this specification. It is to be understood, however, that variations in the showing made by said drawings and description may be adopted within the scope of the invention as set forth in the claims.

BRIEF DESCRIPTION OF THE DRAWINGS

FIG. 1 is a perspective view of a rebar tie constructed in accordance with the present invention.

FIG. 2 is a side elevational view thereof.

FIG. 3 is a rear elevational view thereof.

FIG. 4 is a plan elevational view thereof.

DETAILED DESCRIPTION OF THE INVENTION

With reference to the accompanying drawing, the device 6 of the present invention is designed for securing together engaged overlapping and perpendicularly related horizontal and vertical rebars 7 and 8 and comprises briefly an elongated member formed of stiff resiliently yielding material, such as spring steel, having a curved saddle shaped mid-portion 11 sized to seat on the posterior side of the vertical rebar, i.e., the side away from the horizontal rebar, and having a pair of parallel legs 13 and 14 extending from mid-portion 11 in the plane of curvature thereof. Legs 13 and 14 have a length dimensioned to extend across the top of horizontal rebar 7 as seen in FIGS. 2 and 4 and are curved in parallel planes perpendicular to the plane of curvature of saddle 11 to provide concavities 16 and 17 sized to grip the horizontal rebar 7 and to effect supporting engagement thereof below its horizontal center plane 18 whereby downward load imposed on the horizontal rebar will be translated by arcuate downward displacement of legs 13 and 14 about mid-portion 11 as a fulcrum into lateral pressure of the horizontal rebar against the anterior side 19 of the vertical rebar, legs 13 and 14 being formed for resilient opening of concavities 16 and 17 to admit the horizontal rebar thereto. This particular action of the clip is best illustrated in FIG. 2 from which it will be seen that leg 14 fits around rebar 7 and provides a nestled support therefor, holding rebar 7 against the anterior side 19 of vertical rebar 8. Of importance is the fact that the nestled engagement of rebar 7 extends to a support area 21 below the center plane 18 of the rebar. Consequently as vertical downward load is applied to rebar 7 as for example by workmen climbing on the assembled rebar grid, a clockwise rotating torque, as seen in FIG. 2 is applied to the clip, tending to rotate the clip around its supported mid-portion as a center, thus increasing the locking action. The greater the pressure applied in a locking direction, the greater the holding power of the clip. It is essential that the clip be formed of stiff resilient material so as to maintain its conformation under load. It has been found that hard tempered number 8 and 10 gauge steel wire is satisfactory for use with a wide range of sizes of reinforcing rods, e.g., number 4 through number 18.

As an important feature of the present invention attachment of the clip may be readily accomplished by a simple and easy one-handed operation. To effect installation of the clip, horizontal rebar 7 is positioned at desired elevation on vertical rebar 8. The mid-portion saddle 11 is seated on the posterior side 12 of the vertical rebar with legs 13 and 14 swung up, as illustrated in phantom line in FIG. 2 so as to engage the free ends 22 and 23 with the curved anterior side 24 of horizontal rebar 7 above but adjacent to its horizontal center plane 18 thus producing upon downward movement of the legs a wedged opening of concavities 16 and 17 followed by snap action gripping of the horizontal rebar by the legs upon their further downward arcuate displacement. It will accordingly be noted that the distance between the free ends 22 and 23 and the saddle portion 11 is such as to give the free ends a locus of movement during such downward arcuate displacement intersecting the curved anterior side 24 of the horizontal rebar at a point above its horizontal center plane 18 as illustrated in FIG. 2. Preferably concavities 16 and 17 are of arcuate form and the legs are structured with the free ends 22 and 23 extending tangentally from the concavities. In the preferred structure the arcuate concavities are formed with an interior peripheral service subtending more than 90° so as to extend below the horizontal plane 18 as seen in FIG. 2 but less than 180°. Finally, the portions of legs between concavities 16 and 17 and the free ends 22 and 23 comprise levers 26 and 27 for springing open the concavities into supporting engagement with the horizontal rebar. This action may be readily obtained by the simple expedient of pressing downwardly on legs 13 and 14 and which may be expeditiously accomplished by the workmen using the palm of one hand, leaving his other hand free to support the horizontal rebar at desired position. When adjustment of crossing location of the reinforcing members is required it may be readily accomplished by merely applying an opposite, lifting force to the clip to relieve the locking pressure and to allow adjustment up, down or sideways of the reinforcing members. Downward pressure applied to the clip in the locking direction automatically secures the bars in adjusted position.

The present design of the clip enables its use with more than one size of rebar. For example, a clip formed to handle equal sized crossing bars may be used to secure two or three smaller sizes of crossing bars. Also, a clip formed to handle equal sized crossing bars can be used for the next smaller size equal crossing bars; that is, a clipped formed to handle say number 8 bars can be used to secure number 7 bars, thus reducing the number of different size clips required to be kept on hand by the contractor.

Typically, reinforcing bars are formed with longitudinally spaced peripheral ribs 31 which assist in locating the engaged portions of the clip therebetween.

What is claimed is:

1. In reinforced concrete construction having horizontally spaced vertically extending rebars, and engaged vertically spaced horizontal rebars and tie means securing said rebars at points of intersection and temporarily supporting said horizontal rebars on said vertical rebars, the improvement comprising said tie means and being a one-handled, single-motion, snap-on clip composed of:

an elongated member formed of stiff resiliently yielding material having a curved saddle shaped mid-portion sized to seat on the posterior side of said vertical rebar away from said horizontal rebar and having a pair of parallel legs extending from said mid-portion in the plane of curvature thereof; said legs having a length dimensioned to extend across the top of said horizontal rebar and being curved in parallel planes perpendicular to said first-named plane to provide concavities sized to grip said horizontal rebar and to effect supporting engagement thereof below its horizontal center plane, whereby downward load imposed on said horizontal rebar will be translated into arcuate displacement of said legs about said mid-portion into lateral pressure of said horizontal rebar against the anterior side of said vertical rebar, said concavities having an arcuate form having an interior peripheral surface subtending more than 90° but less than 180°; and said legs having free ends extending substantially tangentially from said concavities and being spaced from said mid-portion by a distance less than the distance between said concavities and said mid-portion and said legs being dimensioned so that said free ends in said arcuate displacement will have a locus of movement intersecting the curved anterior side of said horizontal rebar above and adjacent to its horizontal center plane thus producing a wedged opening of said concavities upon downward arcuate displacement of said legs followed by snap action gripping of said horizontal rebar, the portions of said legs between said concavities and ends comprising levers for springing open said concavities into supporting engagement of said horizontal rebar.

2. The method of securing together engaged, overlapping and perpendicularly related horizontal and vertical rebars comprising:

engaging the posterior side of said vertical rebar, i.e., the side away from said horizontal rebar, with the connecting side of a U-shaped resilient member having spaced apart parallel legs dimensioned to extend across the top of said horizontal rebar and being curved to provide concavities sized to grip said horizontal rebar and free ends positioned to engage the curved anterior side of said horizontal rebar above and adjacent to its horizontal center plane upon downward arcuate displacement of said member about said side;

rotatively displacing said legs about said side and in a downward direction to engage said ends with said horizontal rebar; and applying sufficient downward force on said legs to effect a wedged displacement of said ends on said horizontal rebar and a spring opening and snap action embrace of said concavities about said horizontal rebar.

* * * * *